US007785033B2

(12) United States Patent
Boyd

(10) Patent No.: US 7,785,033 B2
(45) Date of Patent: Aug. 31, 2010

(54) APPARATUS AND METHOD FOR FRAGMENTING AND RE-MIXING AGGLOMERATED PIECES OF RUBBERIZED ASPHALT MATERIAL

(76) Inventor: Robert L. Boyd, P.O. Box 469, Wilton, CA (US) 95693

( * ) Notice: Subject to any disclaimer, the term of this patent is extended or adjusted under 35 U.S.C. 154(b) by 406 days.

(21) Appl. No.: 11/998,122

(22) Filed: Nov. 27, 2007

(65) Prior Publication Data

US 2009/0136295 A1 May 28, 2009

(51) Int. Cl.
*E01C 19/00* (2006.01)

(52) U.S. Cl. ..... 404/75; 404/83; 404/91; 404/92

(58) Field of Classification Search ..... 404/75, 404/81–83, 90–94
See application file for complete search history.

(56) References Cited

U.S. PATENT DOCUMENTS 4,401,265 A * 8/1983 Hofmann ..... 239/1
4,702,643 A * 10/1987 Thilmony ..... 404/121
5,360,288 A * 11/1994 O'Neill et al. ..... 404/129
5,408,810 A * 4/1995 Cullen ..... 53/567
5,642,961 A * 7/1997 Campbell ..... 404/81
6,481,922 B2 11/2002 Boyd
6,505,995 B2 * 1/2003 Sanfilippo et al. ..... 404/94
7,294,204 B2 * 11/2007 Hong et al. ..... 118/323

* cited by examiner

*Primary Examiner*—Raymond W Addie
(74) *Attorney, Agent, or Firm*—R. Michael West

(57) ABSTRACT

An apparatus and method for fragmenting and re-mixing agglomerated pieces of rubberized asphalt prior to applying same to a road surface. Agglomerated pieces and rubberized asphalt material are delivered to the upper portion of a housing. In a first embodiment, an auger and tine assembly having a common drive shaft, is mounted for rotation within the housing. The assembly includes first and second auger sections, mounted along the shaft in spaced relation and having converging, opposite handedness. A rotating tine section is positioned between the auger sections. A fixed tine section is mounted in the housing in interdigitized relation with the rotating tine section. In a second embodiment, the entire drive shaft includes a rotating tine section, and a corresponding interdigitized fixed tine section is provided within the housing. Passing through apertures defined by the fixed and rotating tine sections, agglomerated pieces are fragmented and re-mixed with the other material.

19 Claims, 4 Drawing Sheets

APPARATUS AND METHOD FOR FRAGMENTING AND RE-MIXING AGGLOMERATED PIECES OF RUBBERIZED ASPHALT MATERIAL

BACKGROUND OF THE INVENTION

1. Field of the Invention

The invention relates generally to improvements in the field of windrow elevators used in an asphalt paving machine to pick up, process, and provide a ready supply of asphalt-based material. More specifically, the present invention comprises an apparatus and a method, for fragmenting agglomerated pieces of rubberized asphalt material and re-mixing the fragmented pieces with smaller pieces of the same material, to achieve an acceptably homogeneous consistency in the material readied for immediate use by the asphalt paving machine.

2. Description of the Prior Art

A material commonly known as Hot Mix Asphalt ("HMA") is widely used in roadway construction and resurfacing. HMA is comprised of a mixture of asphalt oil binder, sand, small rocks, and other filler material, processed at a batch plant. Ideally, the batch plant is located close to the paving site, so the HMA will stay hot and workable until it is applied on the roadway. A short transportation distance also minimizes the phenomenon known as material segregation. Because HMA is composed of different sized aggregate and fill material, agitation and gravity act on these pieces of HMA differently. The larger, heavier pieces and the smaller, lighter pieces tend to separate and collect in like groups during transport. When the dump trailer deposits the HMA material on the roadway in a windrow, the smaller particles are concentrated in the central, elevated region of the windrow and the larger particles are concentrated in the lateral, lower regions of the windrow.

U.S. Pat. No. 6,481,922, issued to Boyd, provides a solution to the above-noted material segregation problem. The '922 Patent discloses an apparatus and a method for re-mixing the large particles with the small particles, so that a more uniform mixture of those particles is achieved before the HMA is applied onto the roadway. Through the use of a pair of lateral augers which continuously deliver the larger particles into a centrally positioned stream of the smaller particles, the HMA is re-mixed into a homogeneous mixture before being delivered into a collection hopper for subsequent application on the roadway.

However, as a roadway material, HMA is not without its faults. The asphalt oil binder used to coat and hold the aggregate particles together, plays a critical role in the performance and longevity of the roadway. The adhesive and agglomerating properties of the binder are affected by temperature, the amount and rate of road loading, and aging. Over a period of time, the surface of well-used roads, particularly in harsh environments, begins to crack and delaminate from lower support layers. To mitigate these effects, various additives have been proposed and tested with existing asphalt binders.

One of the most promising and successful additives used so far is rubber, recycled from used motor vehicle tires containing a high content of natural rubber. The tires are ground up into small particles known in the industry as "crumb rubber". Pieces of the steel belts used in the manufacture of tires are removed from the ground up tires, before the crumb rubber is ready for further processing and incorporation into an asphalt based road material. The resultant product is variously known in the paving industry as Rubberized Asphalt, Rubberized Asphalt Concrete ("RAC"), and Asphalt-Rubber.

Two basic methods have been used to make the rubberized asphalt. The first method, known as the "wet process", calls for the crumb rubber to be mixed with the binder (approximately 80% asphalt cement and 20% rubber) in a field blending unit. This first step occurs prior to the addition of the mixture to the other materials at a separate hot mix plant. In a second method, rubberized asphalt can be produced directly, using a terminal blended process where the crumb rubber is added at the refinery or at the asphalt cement terminal. The advantage of the latter method is that no specialized and costly rubberized blending plant is required, and the asphalt binder can be shipped to the hot mix plant just as a standard binder would be.

Irrespective of how it is manufactured, rubberized asphalt has been proven a superior roadway material over unmodified HMA in several significant areas. Rubberized asphalt is highly-skid-resistant, quieter than HMA or concrete, and resistant to rutting and cracking. In the process of making rubberized asphalt, used tires are consumed and utilized for a new purpose. A two-inch thick roadway resurfacing project can consume approximately 2000 waste tires per lane per mile. Thus, land-fill can be reduced and environmental concerns associated with the storage of flammable stores of waste tires are alleviated. Research has established that 4" thick conventional HMA roadway can be replaced with 2" thick rubberized asphalt, and achieve the same fatigue life. Rubberized asphalt provides excellent long-lasting, color contrast, for road striping and marking. Lastly, rubberized asphalt can generally be applied using conventional road-paving equipment and methods.

The last mentioned feature of rubberized asphalt has several exceptions, however. Rubberized asphalt is made using smaller and more uniform aggregate, typically on the order of ¼" to ⅜", or so, in diameter. This results in a material which is much less susceptible to the segregation problem caused by material transport, characteristic of HMA. But rubberized asphalt cools at a different rate than HMA, and it has a tendency to agglomerate in ways that HMA does not. Between the batch plant where the rubberized asphalt is manufactured and the roadway job site, cooling of the material occurs, especially in areas contingent and adjacent the sidewall and floor of the material hopper.

When rubberized asphalt has cooled a sufficient amount before it is even deposited into a windrow on the roadway, it may agglomerate into relatively large balls or sheets of material of irregular size and shape known as "clingers". For example, a sheet of such agglomerated material may be 2" to 3" thick, 4" to 5" wide, and 12" to 18" long. These large pieces of agglomerated material are randomly dispersed through the windrow.

The present practice is to remove such agglomerated material manually from the windrow, before material pickup and application of the rubberized asphalt to the roadway occurs. This method is labor intensive, and also relies upon the workers finding and removing all of the offending clingers. If not removed, such large chunks of agglomerated material may jam in the paving machine or be deposited into the roadway and remain an unintegrated surface component.

SUMMARY OF THE INVENTION

The present invention comprises an apparatus and a method for fragmenting agglomerated pieces of rubberized asphalt material, and then re-mixing the smaller fragmented pieces with the smaller loose material prior to applying the re-mixture to a road surface. The agglomerated pieces are formed from smaller pieces of rubberized asphalt material which have cooled together to form the agglomerated pieces, during transport to the job site. A random mixture of agglomerated pieces and the rubberized asphalt material is delivered to the job site, forming a windrow along the middle of the roadway. A pickup machine passes over the windrow, and an elevator picks up the mixture. The elevator carries the mixture upwardly, and delivers it to the upper portion of a generally cylindrical housing mounted on the pickup machine.

In a first embodiment, an auger and tine assembly having a common drive shaft, is mounted for rotation within the housing. The assembly includes first and second auger sections, mounted along the drive shaft in spaced relation. A rotating tine section is mounted on the drive shaft between the auger sections. The auger sections have converging, opposite handedness, effective to transport the agglomerated pieces and the material inwardly toward the rotating tine section. A fixed tine section is mounted in the housing in interdigitized relation with the rotating tine section.

In a second embodiment, a rotating tine section extending the entire length of the drive shaft, is provided within the housing. A fixed tine section is also provided within the housing, having a length corresponding to that of the rotating tine section. As with the first embodiment, the fixed tine section is arranged in interdigitized relation with the tines of the rotating tine section.

In both embodiments, the agglomerated pieces and the material are deposited into a fragmenting and re-mixing zone adjacent and around the rotating and fixed tine sections. The spacing between adjacent fixed and rotating tines is such that a pre-determined maximum size is established for agglomerated pieces fragmented by the action of the tines. These smaller fragmented pieces are concurrently re-mixed with the other material resulting in rubberized asphalt having a size and composition appropriate to form a road surface.

The first embodiment of the invention can also be used advantageously with HMA paving material, to alleviate the material segregation. In other words, without making any modifications or changes to its structure or operation, the same apparatus which fragments and re-mixes rubberized asphalt material will also re-mix size and weight segregated HMA into a homogeneous material ready for instant use by a paving machine.

DETAILED DESCRIPTION OF THE PREFERRED EMBODIMENT

Figure 1:
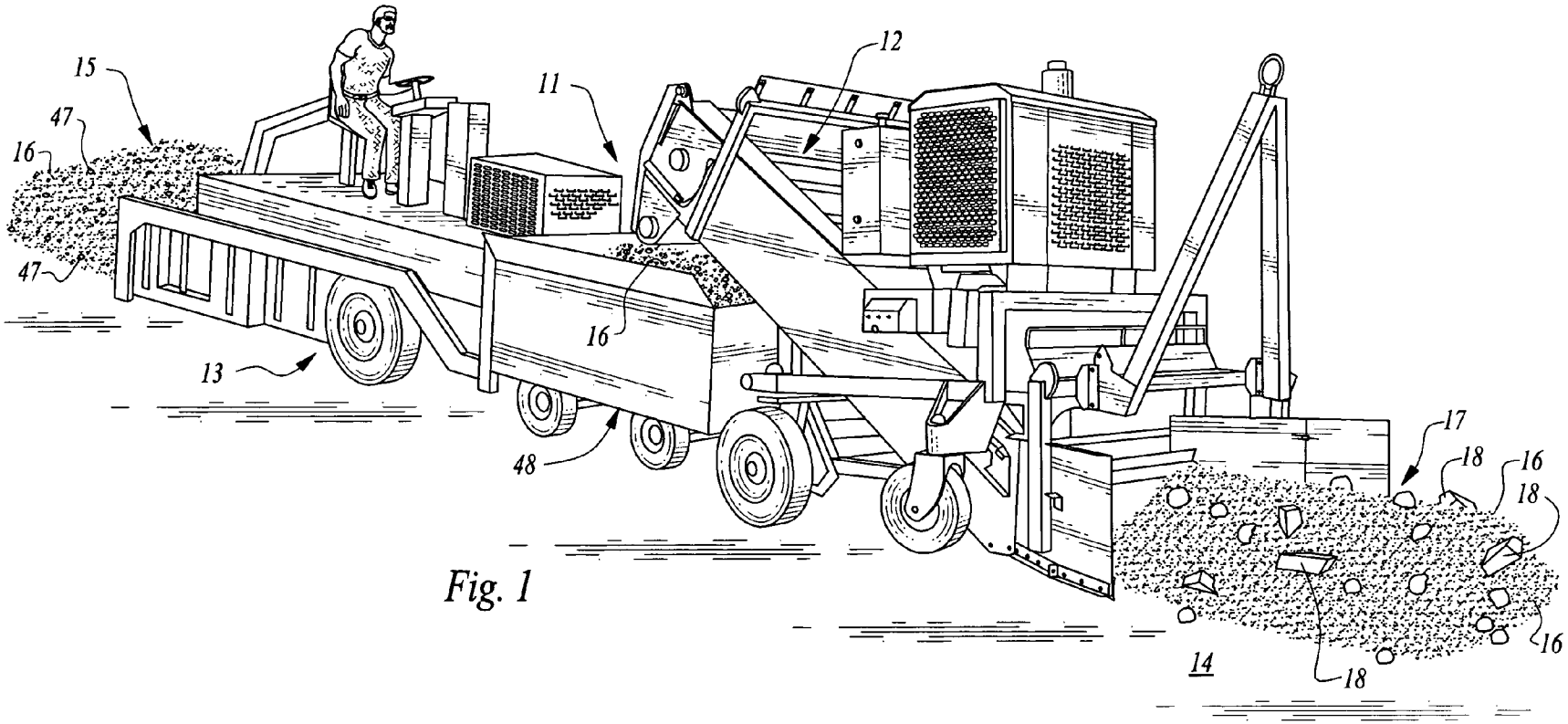
FIG. 1 is a perspective view, showing a road paving machine incorporating the apparatus for fragmenting and re-mixing agglomerated pieces of rubberized asphalt material of the present invention.
Figure 2:
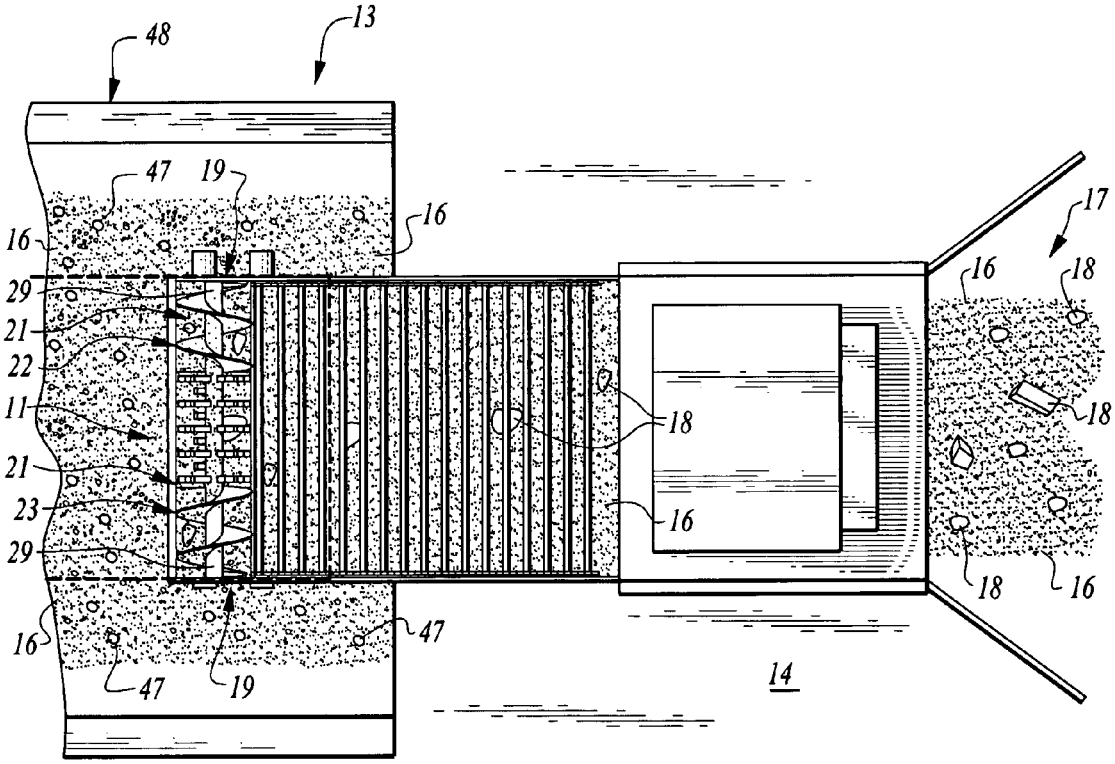
FIG. 2 is a fragmentary top plan view of the road paving machine, with portions of the cover and the housing broken away to show the windrow elevator, the auger sections, and the tine section.
Figure 3:
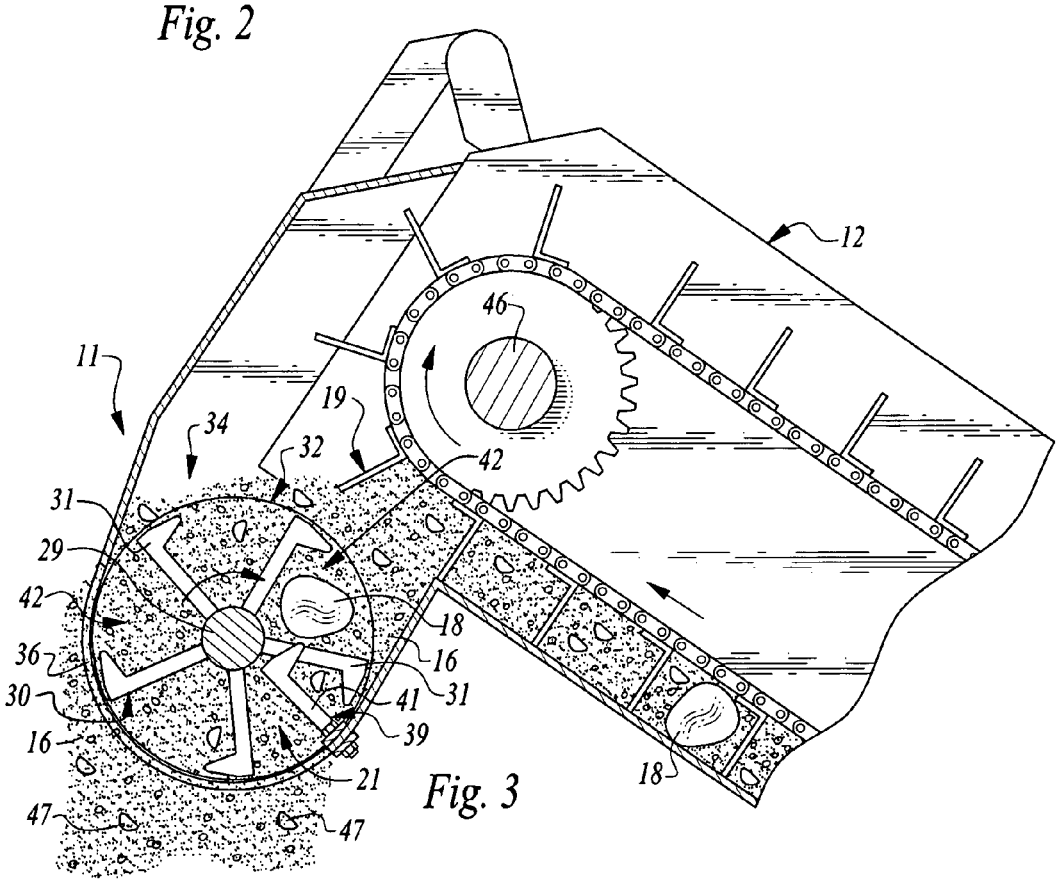
FIG. 3 is a fragmentary cross-sectional view, taken through the longitudinal axis of the windrow elevator of FIG. 2, showing the delivery of rubberized asphalt material into the auger and tine housing.
Figure 4:
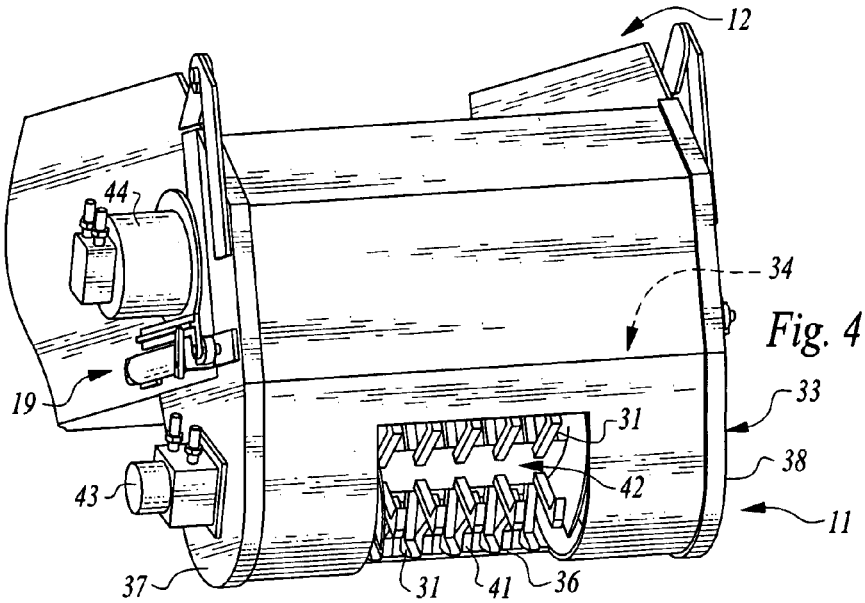
FIG. 4 is a fragmentary perspective view showing the upper end of the elevator and the auger and tine housing of the first embodiment.

Turning now to FIG. 1, the fragmenting and re-mixing apparatus 11 of the present invention is shown in combination with a windrow elevator 12 and a paving machine 13. At the job site depicted in FIG. 1, the paving machine 13 is re-paving a roadway surface 14 with a mat 15 of rubberized asphalt 16.

At an off-site batch plant, the rubberized asphalt material 16 is manufactured from first combining a hot and liquid asphalt cement binder with particles of rubber. Generally, the amount of rubber in the mixture will vary from approximately 15% to 25%, or so, by weight. The rubber is preferably in the form of recycled "crumb rubber", made from used automobile and small truck tires which have been shredded to a crumb-like size and consistency. At the plant, this crumb rubber has been heated to a sufficient amount that it physically swells, enabling it to combine and integrate with the asphalt cement. Next, this asphaltic combination is mixed with aggregate, such as crushed rock. The aggregate used in making rubberized asphalt is fairly small and uniform in size, ranging from ¼" to ⅜", or so, in diameter. This hot mixture is then loaded into a belly dump trailer, and the trip to the job site begins.

The best case scenario for transporting rubberized asphalt is a short trip during the hottest part of the day during the summer season. Deviations from those circumstances during transport will cause varying amounts of greater cooling to the rubberized asphalt mixture. The most critical areas for cooling tend to be around the floor and sidewalls of the trailer, where the mass of the metal plates and the trailer frame can absorb heat from the mixture. In contrast to HMA, rubberized asphalt cools and agglomerates more quickly. With more paving and re-paving jobs occurring during evening hours to avoid traffic delays, the problem with material agglomeration has become worse for rubberized asphalt jobs.

Upon arrival at the job site, the belly dump trailer deposits its load of rubberized asphalt material 16 in a windrow 17. Under circumstances where the material had sufficiently cooled during transport, agglomerated pieces 18 in various shapes and sizes known as "clingers" have formed. As shown in FIG. 1, these pieces may be globular or sheet-like in configuration. Reports indicate that the sheet pieces appear to peel off the floors and sidewalls of the trailer, and these pieces may be 2" to 3" thick, 4" to 5" thick, and 12" to 18" in size. The agglomerated pieces are randomly dispersed throughout the windrow, with some pieces exposed and others located within the body of the windrow out of sight. Heretofore, these pieces have been manually removed from the windrow, by workers who pick through the windrow before the paving machine 13 reaches the freshly dumped rubberized asphalt material.

A paving machine 13 fitted with the fragmenting and re-mixing apparatus 11 of the present invention does not need additional workers to remove clingers or agglomerated pieces 18 from the windrow 17. Instead, the apparatus 11 aboard the paving machine 13 is capable of processing the agglomerated pieces in such a way that it can be intermixed with the remainder of the material and incorporated directly into the mat 15.

To that end, as the paving machine 13 advances over the windrow 17, the windrow elevator 12 picks up the rubberized asphalt material 16 including the agglomerated pieces 18 in the usual way and delivers it to an upper discharge end 19 of the windrow elevator 12.

Figure 5:
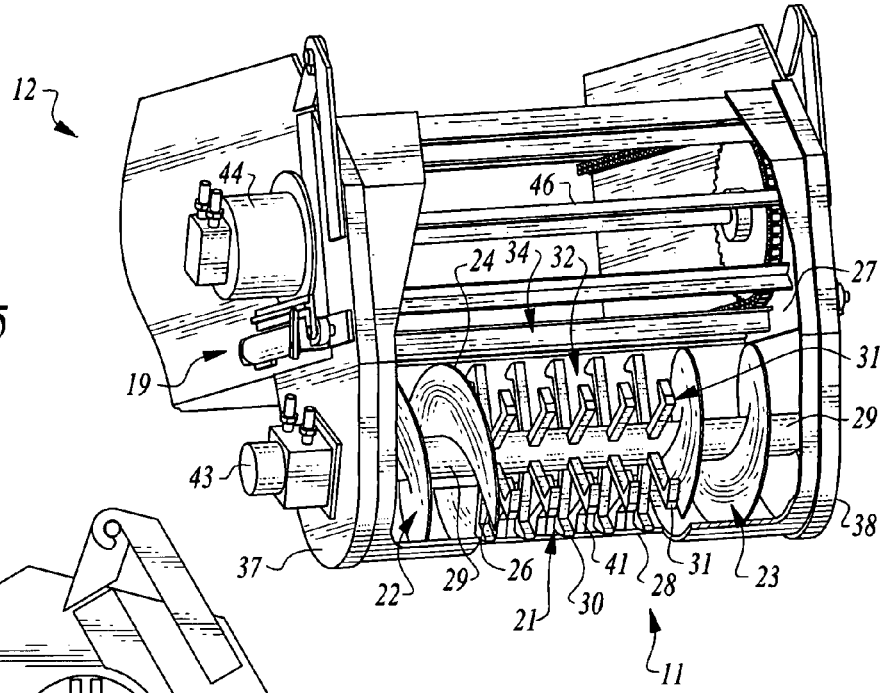
FIG. 5 is a view as in FIG. 4, but with a portion of the housing broken away to show the arrangement of the auger sections and the tine sections.
Figure 6:
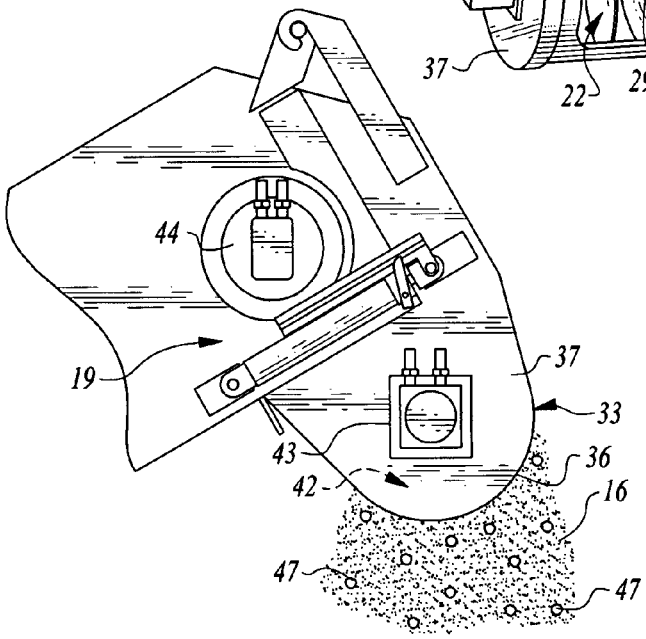
FIG. 6 is a side elevational view of the auger and tine housing, showing discharge of the fragmented and re-mixed rubberized asphalt material.

As shown in the various Figures, the apparatus 11 is located at the discharge end 19, and comprises an auger and tine assembly 21 having a first helical auger section 22 and a second helical auger section 23. First auger section 22 has a top portion 24 and an inner portion 26. Second auger section 23 has a top portion 27 and an inner portion 28 opposing inner portion 26. As shown most clearly in FIG. 5, auger section 22 and auger section 23 are mounted in spaced relation over respective ends of a rotatable drive shaft 29.

A rotating tine section 30 having a top portion 32 is mounted on drive shaft 29 between inner portions 26 and 28. The rotating tine section 30 is comprised of a plurality of tines 31, arranged in a plurality of rows, extending perpendicularly from drive shaft 29. Each of the rotating tines comprises an inner shank portion and an enlarged outer head portion, especially adapted for fragmenting agglomerated pieces 18. It should be noted that the first and second auger sections are of converging, opposite handedness, so as to advance rubberized asphalt material 16 and the agglomerated pieces 18 inwardly toward the rotating tine section 30.

Apparatus 11 further comprises an auger and tine housing 33 having an upper portion with a material inlet 34 and a lower portion with a material discharge 36. Housing 33 also includes a first endwall 37 and a second endwall 38. Auger and tine assembly 21 is mounted for rotation within the lower portion of housing 33 between said first endwall 37 and second endwall 38. A fixed tine section 39 is mounted in housing 33 in interdigitized relation with rotating tine section 30. Tine section 39 is comprised of a plurality of fixed tines 41, welded to a plate bolted to auger and tine housing 33. Fixed tines 41 are arranged in a row, extending in perpendicular fashion from the axis of drive shaft 29. Preferably, material discharge 36 is located just below tine section 39.

The spacing between fixed tines 41 and an adjacent rotatable tine 31 is approximately 1" to 1½", or so, thereby establishing a maximum transverse dimension for agglomerated pieces as they are forced between the two structures. This dimension can be changed as the circumstances demand. For example, smaller fragmented pieces may be achieved by reducing the spacing between the rotating and stationary tines. This will provide the paving machine with an even more homogeneous mixture, as the fragmenting process will produce smaller pieces. The downside of such a modification, is that the material "throughput" of the apparatus 11 will be reduced. This will necessarily reduce the speed of the paving machine 13.

Material inlet 34 in housing 33 allows rubberized asphalt 16 and agglomerated pieces 18 to be delivered into the top portions of the first and second auger sections and the rotating tine section. The remainder of auger and tine housing 33 substantially surrounds the first auger section 22, the second auger section 23, the rotating tine section 30, and the fixed tine sections 39. The first auger section and the second auger section acting in conjunction with the housing 33, transport and direct asphalt 16 and agglomerated pieces 18 to the rotating tine section 30. Housing 33 further defines a fragmenting and re-mixing zone 42 adjacent and around rotating and fixed tine sections 30 and 39.

Drive means 43, preferably a hydraulic motor, is provided for rotating drive shaft 29 and auger and tine assembly 21 at the desired speed. If more aggressive fragmenting and re-mixing is desired or necessary, the speed of drive means 43 may be increased. This might be appropriate, for example, where more than the usual number of agglomerated pieces 18 are found in a particular load. A hydraulic motor 44 is included on drive shaft 46 of windrow elevator 12, to provide a continuous stream of rubberized asphalt material 16 and agglomerated pieces 18 into the material inlet 34. In operation, agglomerated pieces and material entering the material inlet are advanced inwardly toward the center of housing 33, and deposited onto the rotating tine section and the fixed tine section in the fragmenting and re-mixing zone 42. In this manner, the agglomerated pieces are fragmented and re-mixed with the asphalt material before passing through the material discharge 36.

The fragmented pieces 47 and the rubberized material 16 are deposited as a substantially homogeneous mixture into a hopper 48, in readiness to be utilized by the paving machine 13. The size and physical shape of the pieces 47 is such that when the mat 15 is laid by the paving machine 13 and subsequently compressed by a street roller, all of the rubberized asphalt forms a uniform and structurally integrated surface that is durable and long-lasting.

Figure 7:
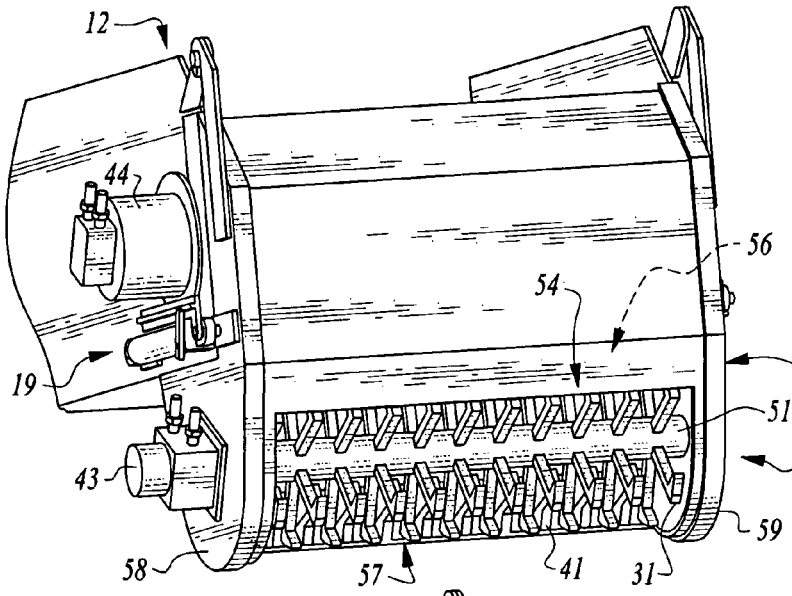
FIG. 7 is a fragmentary perspective view showing the upper end of the elevator and the tine housing of the second embodiment.
Figure 8:
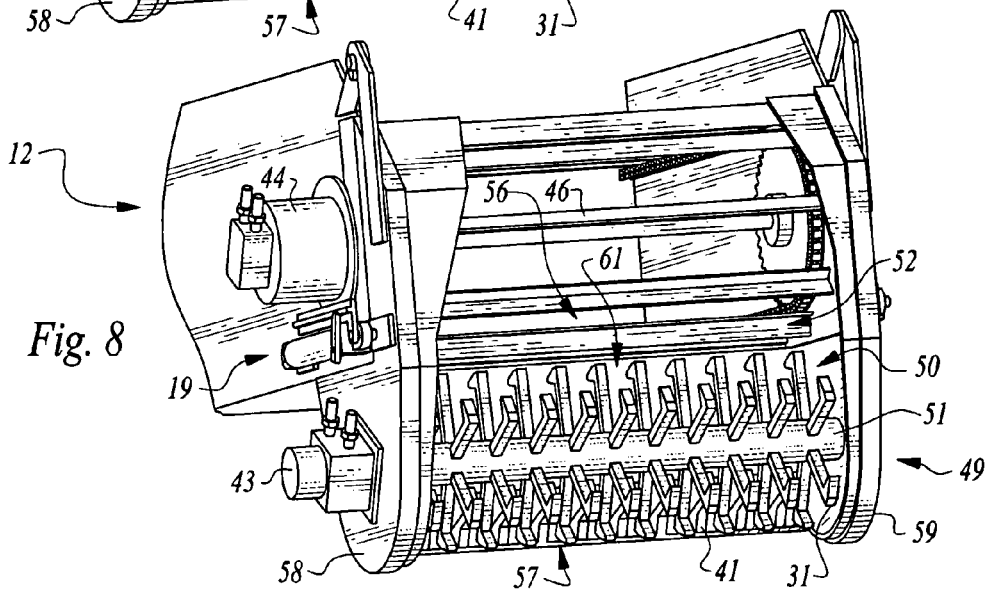
FIG. 8 is a view as in FIG. 7, but with a portion of the housing broken away to show the tine section; and, FIG. 9 is a front elevational view of the tine housing, showing discharge of the fragmented and re-mixed rubberized asphalt material.
Figure 9:
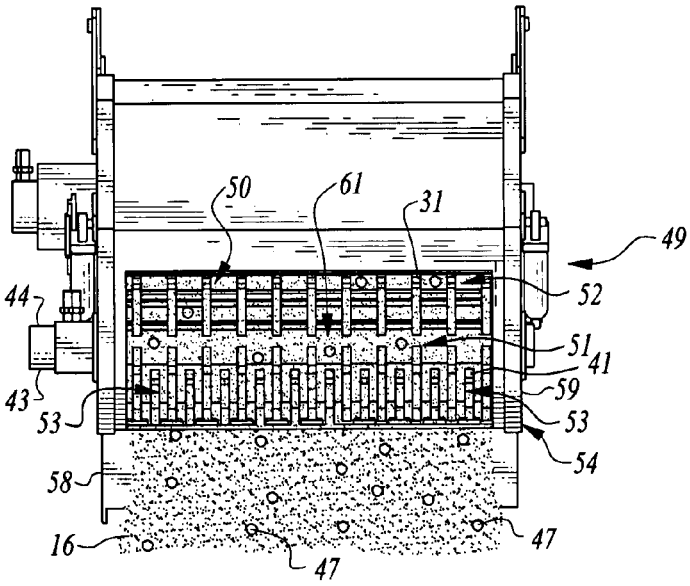

Apparatus 49, comprising a second embodiment of the invention, is shown in FIGS. 7-9. For the sake of clarity, the same element numbers will be used in describing this embodiment, where the structure and operation of those elements are identical to those in the first embodiment, set forth above. It should also be noted that this second embodiment is also an apparatus for fragmenting and re-mixing rubberized asphalt material containing agglomerated pieces, and may be used interchangeably in the same application as the apparatus of the first embodiment. Therefore, since the structure and operation of the upstream and downstream components, such as the windrow elevator, hopper, and paver devices have already been described, this discussion will not be repeated.

Apparatus 49 includes a rotating tine section 50, mounted on a rotatable drive shaft 51. Rotating tine section 50 comprises of a plurality of tines 31, arranged in a plurality of rows, extending radially from drive shaft 51. For ease of construction, tine section 50 may be welded to a pipe or tube (not shown) which fits over and is bolted to drive shaft 51. Alternatively, the tines may be welded directly to shaft 51. Tine section 50 also includes a top portion 52, into which incoming rubberized asphalt 16 and agglomerated pieces 18 are deposited.

Apparatus 49 also includes a fixed tine section 53. As is shown most clearly in FIG. 9, fixed tine section 53 is substantially coextensive in length with rotating tine section 50. Fixed tine section 53 is comprised of a plurality of tines 41, arranged in a row and extending perpendicularly from drive shaft 51. Each of the rotating and fixed tines comprises an inner shank portion and an enlarged outer head portion, especially adapted for fragmenting agglomerated pieces 18. It should also be noted that the enlarged outer head portions of the rotating and fixed tines are arranged in opposing relation, to enhance the fragmentation and re-mixing process.

Apparatus 49 also includes a tine housing 54, having an upper portion with a material inlet 56 and a lower portion with a material discharge 57. Tine housing 54 further has a first endwall 58 and a second endwall 59. Rotating tine section 50 is mounted for rotation within the lower portion of housing 54, between the first and second endwalls. FIG. 9 shows that fixed tine section 53 is mounted in tine housing 54, in interdigitized relation with rotating tine section 50. The spacing between adjacent rotating and fixed tines is selected to ensure a maximum acceptable size for the fragmented pieces discharged from the apparatus 49.

Tine housing 54 substantially surrounds rotating tine section 50 and fixed tine section 53, but leaves the top portion 52 of the rotating tine section exposed to material inlet 56. Rubberized asphalt and agglomerated pieces of asphalt are thereby delivered into the rotating tine section. Tine housing 54 further defines a fragmenting and re-mixing zone 61 adjacent and around the rotating tine section 50 and the fixed tine section 53.

Drive means 43 is also provided, for rotating tine section 50 at an appropriate speed. Preferably, a hydraulic motor is used for drive means 43, as the speed of the rotating tines can easily be changed by the operator independently either from the forward speed of the paving machine 13 or from the speed of the windrow elevator 12.

In operation, rubberized asphalt material 16 and agglomerated pieces 18 entering the material inlet 56 are deposited onto the rotating tine section 50 and the fixed tine section 53 in the fragmenting and mixing zone 61. The agglomerated pieces which are larger than the space between the rotating tines and the fixed tines are fragmented and re-mixed with the asphalt material 16 before the homogeneous mixture passes through the material discharge 57. In all other respects, the operation and general function of the second embodiment, represented by the apparatus 49 is identical to that of the first embodiment, represented by the apparatus 11.

What is claimed is:

1. An apparatus for fragmenting and re-mixing rubberized asphalt material containing agglomerated pieces, comprising:

a. an auger and tine assembly having a first helical auger section and a second helical auger section, both said first and second sections having top portions and opposing inner portions and being mounted in spaced relation over respective ends of a rotatable drive shaft, a rotating tine section having a top portion and being mounted on said drive shaft between said inner portions, said first and second auger sections further being of converging, opposite handedness, so as to advance material and the agglomerated pieces inwardly toward said rotating tine section;

b. an auger and tine housing having an upper portion with a material inlet and a lower portion with a material discharge, said housing further having a first endwall and a second endwall, said auger and tine assembly being mounted for rotation within said lower portion between said first and second endwalls, and a fixed tine section being mounted in said housing in interdigitized relation with said rotating tine section, said material discharge being located below said fixed tine section, said housing substantially surrounding said first and second auger sections and said rotating and fixed tine sections, but leaving said top portions of said first and second auger sections and said rotating tine section exposed to said material inlet, said housing further including a fragmenting and re-mixing zone the fragmenting and re-mixing zone includes a plurality of fixed tines arranged in interdigitized relation with a plurality of rotating tines adjacent and around said rotating and fixed tine sections;

c. drive means for rotating said auger and tine assembly, whereby agglomerated pieces and material entering said material inlet are advanced and deposited onto said rotating tine section and said fixed tine section in said fragmenting and re-mixing zone, wherein agglomerated pieces are fragmented and re-mixed with asphalt material before passing through said material discharge.

2. An apparatus as in claim 1 in which said rubberized asphalt material has a concentration of crumb rubber, by weight, in the range of approximately 15% to 25%.

3. An apparatus as in claim 1 in which said drive means is a hydraulic motor.

4. An apparatus as in claim 1 in which said drive shaft includes ends supported by bearings on said first endwall and said second endwall.

5. An apparatus as in claim 1 in which said rotating tine section comprises a plurality of rotating tines extending radially from said drive shaft.

6. An apparatus as in claim 5 in which said rotating tines are arranged in a plurality of rows, and in which each of said rotating tines comprises an inner shank portion and an enlarged outer head portion.

7. An apparatus as in claim 5 in which said fixed tine section comprises a plurality of fixed tines arranged in spaced relation in a row, said fixed tines being spaced from an adjacent rotating tine a sufficient distance so that agglomerated pieces drawn between said fixed tine and said rotating tine are fragmented into a predetermined maximum size.

8. An apparatus as in claim 1 in which said upper portion of said auger and tine housing is mounted to an upper, discharge end of a windrow elevator.

9. An apparatus for fragmenting and re-mixing rubberized asphalt material containing agglomerated pieces, comprising:

a. a rotating tine section having a top portion and being mounted on a rotatable drive shaft;

b. a fixed tine section, said fixed tine section being substantially coextensive in length with said rotating tine section;

c. a tine housing having an upper portion with a material inlet and a lower portion with a material discharge, said housing further having a first endwall and a second endwall, said rotating tine section being mounted for rotation within said lower portion between said first and second endwalls, said fixed tine section being mounted in said housing in interdigitized relation with said rotating tine section, said housing substantially surrounding said rotating and fixed tine sections, but leaving said top portion of said rotating tine section exposed to said material inlet, said housing further including a fragmenting and re-mixing zone adjacent and around said rotating and fixed tine sections;

d. drive means for rotating said tine section, by which agglomerated pieces and material entering said material inlet are deposited onto said rotating tine section and said fixed tine section in said fragmenting and mixing zone, and whereby agglomerated pieces are fragmented and re-mixed with asphalt material before passing through said material discharge.

10. An apparatus as in claim 9 in which said material discharge extends the length of said fixed tine section.

11. An apparatus as in claim 9 in which said drive shaft includes ends supported by bearings on said first endwall and said second endwall.

12. An apparatus as in claim 9 in which said rotating tine section comprises a plurality of rotating tines extending radially from said drive shaft.

13. An apparatus as in claim 12 in which said rotating tines are arranged in a plurality of rows, and in which each of said rotating tines comprises an inner shank portion and an enlarged outer head portion.

14. An apparatus as in claim 12 in which said fixed tine section comprises a plurality of fixed tines arranged in spaced relation in a row, said fixed tines being spaced from an adjacent rotating tine a sufficient distance so that agglomerated pieces drawn between said fixed tine and said rotating tine are fragmented into a predetermined maximum size.

15. An apparatus as in claim 9 in which said upper portion of said tine housing is mounted to an upper, discharge end of a windrow elevator.

16. A method for fragmenting and re-mixing rubberized asphalt material containing agglomerated pieces of rubberized asphalt material comprising the steps of:

a. providing a continuous stream of agglomerated pieces and asphalt material randomly distributed across a width having opposing lateral regions straddling a central region;

b. continuously moving said agglomerated pieces and asphalt material from said lateral regions inwardly toward a fragmenting and re-mixing zone, said fragmenting and re-mixing zone including a plurality of fixed tines arranged in interdigitized relation with a plurality of rotating tines;

c. continuously delivering agglomerated pieces and asphalt material from said central region to said fragmenting and re-mixing zone;

d. continuously fragmenting said agglomerated pieces into a pre-determined maximum size and re-mixing them with said asphalt material in said fragmenting and mixing zone, to achieve a substantially uniform distribution of fragmented agglomerated pieces of a pre-determined maximum size within the re-mixed material.

17. A method as in claim 16 in which the step of fragmenting agglomerated pieces comprises forcing said agglomerated pieces through an aperture having a pre-determined transverse dimension.

18. A method as in claim 16 in which said agglomerated pieces are randomly comprised of generally globular and generally sheet-like configurations.

19. A method as in claim 16 in which said rubberized asphalt material has a concentration of crumb rubber, by weight, in the range of approximately 15% to 25%.

* * * * *

UNITED STATES PATENT AND TRADEMARK OFFICE

CERTIFICATE OF CORRECTION

PATENT NO. : 7,785,033 B2
APPLICATION NO. : 11/998122
DATED : August 31, 2010
INVENTOR(S) : Robert L. Boyd It is certified that error appears in the above-identified patent and that said Letters Patent is hereby corrected as shown below:

In Column 7, Claim 1, lines 57 through 59, delete "includes a plurality of fixed tines arranged in interdigitized relation with a plurality of rotating tines"

Signed and Sealed this

Nineteenth Day of October, 2010

David J. Kappos

David J. Kappos
*Director of the United States Patent and Trademark Office*